US010546667B2

(12) United States Patent
Ushiwata et al.

(10) Patent No.: US 10,546,667 B2
(45) **Date of Patent: *Jan. 28, 2020**

(54) INSULATED WIRE AND COIL USING SAME

(71) Applicant: HITACHI METALS, LTD., Tokyo (JP)

(72) Inventors: Takami Ushiwata, Hitachi (JP); Yuki Honda, Hitachi (JP); Shuta Nabeshima, Hitachi (JP); Hideyuki Kikuchi, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 151 days.

This patent is subject to a terminal disclaimer.

(21) Appl. No.: 14/054,024

(22) Filed: Oct. 15, 2013

(65) Prior Publication Data

US 2014/0102752 A1 Apr. 17, 2014

(30) Foreign Application Priority Data

Oct. 16, 2012 (JP) ..... 2012-228586

(51) Int. Cl.
*H01B 7/29* (2006.01)

(52) U.S. Cl.
CPC ..... *H01B 7/292* (2013.01); *Y10T 428/294* (2015.01)

(58) Field of Classification Search
CPC ..... H01B 3/306; H01B 7/292; H01B 3/308; C08G 73/1067; C08G 73/1071;
(Continued)

(56) References Cited

U.S. PATENT DOCUMENTS 3,518,219 A * 6/1970 Markhart et al. ..... 524/879
4,535,105 A 8/1985 Inaike et al.
(Continued)

FOREIGN PATENT DOCUMENTS

CN 1693338 A * 11/2005
CN 1693338 A 11/2005
(Continued)

OTHER PUBLICATIONS

Machine translation of CN 1693338 A, retrieved Oct. 18, 2017.*
(Continued)

*Primary Examiner* — Callie E Shosho
*Assistant Examiner* — Krupa Shukla
(74) *Attorney, Agent, or Firm* — Foley & Lardner LLP

(57) ABSTRACT

An insulated wire includes a conductor and an insulating layer formed on an outer periphery of the conductor, and the insulating layer is composed essentially of a polyimide resin having a repeating unit A represented by Formula (1) as a part of a molecular structure, in which a water absorption coefficient is not greater than 2.8% after 24 hours under condition at temperature of 40° C. and humidity of 95%.

(1)

3 Claims, 1 Drawing Sheet

(58) Field of Classification Search
CPC ..... C08G 73/1007; C08G 73/1042; C08G 73/105; C08G 73/10; C08G 73/1053; Y10T 428/294; Y10T 428/31721; Y10T 428/31678; Y10T 428/31681; Y10T 428/31692; C08L 79/08; C09D 179/08; H05K 2201/0154; H05K 1/056; B32B 15/08; B32B 2379/08
USPC ..... 428/425.8, 458, 461; 427/340, 385.5, 427/331
See application file for complete search history.

(56) References Cited

U.S. PATENT DOCUMENTS

| | | | | |
|---|---|---|---|---|
| 4,568,715 | A * | 2/1986 | Itatani et al. | 524/348 |
| 5,518,864 | A | 5/1996 | Oba et al. | |
| 6,288,342 | B1 | 9/2001 | Ueoka et al. | |
| 8,986,834 | B2 | 3/2015 | Kikuchi et al. | |
| 2003/0082925 | A1* | 5/2003 | Yano | G03F 7/0387 438/778 |
| 2009/0176961 | A1 | 7/2009 | Kikuchi et al. | |
| 2010/0206611 | A1 | 8/2010 | Honda et al. | |
| 2010/0229517 | A1 | 9/2010 | Fujihara | |
| 2011/0024156 | A1* | 2/2011 | Ando | H01B 3/006 174/110 SR |
| 2012/0048592 | A1 | 3/2012 | Kikuchi et al. | |
| 2012/0301718 | A1 | 11/2012 | Nishiura et al. | |
| 2013/0000951 | A1 | 1/2013 | Honda et al. | |
| 2013/0098656 | A1 | 4/2013 | Saito et al. | |
| 2013/0161061 | A1 | 6/2013 | Honda et al. | |
| 2014/0065421 | A1 | 3/2014 | Ushiwata et al. | |

FOREIGN PATENT DOCUMENTS

| | | | | |
|---|---|---|---|---|
| CN | 102385948 | A | | 3/2012 |
| JP | 51-007098 | A | | 1/1976 |
| JP | 61-273806 | U | | 12/1986 |
| JP | 61-285617 | A | | 12/1986 |
| JP | 63-221126 | A | | 9/1988 |
| JP | 09-106712 | | | 4/1997 |
| JP | 09-106712 | A | | 4/1997 |
| JP | 2001081213 | A | * | 3/2001 |
| JP | 2005-057113 | A | | 3/2005 |
| JP | 2009-161683 | A | | 7/2009 |
| JP | 2010-132725 | A | | 6/2010 |
| JP | 2010-189510 | A | | 9/2010 |
| JP | 2011-009015 | A | | 1/2011 |
| WO | WO-2011/063238 | A1 | | 5/2011 |
| WO | WO-2011/093079 | | | 8/2011 |
| WO | WO-2012/102121 | | | 8/2012 |
| WO | WO-2013/136807 | | | 9/2013 |

OTHER PUBLICATIONS

Machine translation of JP-2001081213-A, retrieved Jun. 15, 2019. (Year: 2001).*
Japanese Office Action, dated Dec. 2, 2014, 4 pages.
Japanese Office Action, dated Feb. 19, 2015, 4 Pages.
Japanese Office Action, dated Dec. 9, 2014, 6 pages.
Japanese Office Action, dated Jan. 6, 2015, 8 pages.
USPTO Office Action, U.S. Appl. No. 13/689,629, dated Sep. 16, 2014, 13 pages.
USPTO Office Action, U.S. Appl. No. 13/689,629, dated Apr. 22, 2015, 18 pages.
USPTO Office Action, U.S. Appl. No. 14/012,210, dated Oct. 6, 2015, 10 pages.
Chinese Office Action for application No. 201310395113.1, dated Feb. 3, 2016 and English translation.
USPTO Office Action, U.S. Appl. No. 14/012,210, dated Jun. 8, 2016, 11 pages.
Chinese Office Action, Application No. 201310485325.9, dated Apr. 15, 2016, 9 pages.
Chinese Office Action and English translation, dated Aug. 16, 2016, 9 pages.
Japanese Notice of Reasons for Revocation and English translation, dated May 20, 2016, 13 pages.
Chinese Office Action and English translation, Application No. 201310485325.9, dated Dec. 28, 2016, 9 pages.

* cited by examiner

INSULATED WIRE AND COIL USING SAME

The present application is based on Japanese patent application No. 2012-228586 filed on Oct. 16, 2012, the entire contents of which are incorporated herein by reference.

BACKGROUND OF THE INVENTION

1. Field of the Invention

The present invention relates to an insulated wire and a coil using the same, more particularly, to an insulated wire and a coil using the same, to be used in motors and the like.

2. Description of the Related Art

An electrical equipment such as motor typically comprises a coil. A coil in motors is formed with using an insulated wire, and is formed by winding the insulated wire around a core of the motor, or joining the insulated wires together by welding or the like. The insulated wire comprises an insulative coating (insulating layer) on an outer periphery of a conductor. The insulating layer is formed by applying an insulative varnish containing a resin component dissolved in an organic solvent to the conductor, and baking the conductor with the insulative varnish.

Various characteristics such as mechanical characteristics and heat resistance have been required for the insulating layer of the insulated wire. As one of insulating layers satisfying the aforementioned characteristic requirements, an insulating layer using polyimide resin has been known. The polyimide resin is formed by imidization by heating polyamide acid (polyamic acid), which is synthesized from carboxylic anhydride and diamine. For example, JP-A 9-106712 discloses polyimide resin formed from polyamic acid, which is synthesized from, e.g., pyromellitic dianhydride (PMDA) as carboxylic anhydride and 4,4'-diaminodiphenyl ether (ODA) as diamine.

As well as the mechanical characteristics and heat resistance, a high partial discharge inception voltage (PDIV) is required for the insulating layer. The "partial discharge" is a phenomenon that the electric discharge occurs due to the electric charge concentrated at a small gap between adjacent insulated wires when voltage is applied to the conductor. The partial discharge inception voltage (Hereinafter also referred to as "PDIV") means an applied voltage when the partial discharge starts to occur. The occurrence of the partial discharge does not cause the insulation breakdown immediately. The insulating layer is however eroded gradually by the partial discharge occurred therein, which eventually causes the insulation failure. In an insulating layer with a low partial discharge inception voltage (PDIV), the partial discharge is likely to occur at lower voltage, so that high PDIV is required in the insulating layer.

SUMMARY OF THE INVENTION

In recent years, the motors used for industrial equipment have been reduced in size and weight. In addition, inverter drive for improving dynamic performance, together with high voltage drive for high power output, is being developed rapidly. Since the motor is driven at high voltage and at the same time is inverter-driven, the overlapping of the high voltage drive with the inverter drive increases the risk of partial discharge occurrence in an insulated wire of the motor. Therefore, higher PDIV is required in an insulating layer of an insulated wire.

When the higher power output and miniaturization of the motor are intended as described above, thin thickness and high PDIV are required in an insulating layer of an insulated wire to be used in the motor. More concretely, PDIV at a film thickness of 40 μm is needed to be not less than 900 Vp.

However, the polyimide disclosed by JP-A 9-106712 has relatively high relative permittivity. In case that an insulating layer formed of the polyimide disclosed by JP-A 9-106712 has a thin thickness, it is difficult to achieve a sufficient PDIV level. PDIV of the insulating layer can be improved by increasing a film thickness of the insulating layer. However, the use of a thick insulating layer increases a diameter of the insulated wire, thereby decreases a space factor of the insulated wire or suppresses the miniaturization of the motor. Accordingly, the environment of using the insulated wire with the insulating layer formed of the polyimide disclosed by JP-A 9-106712 is restricted for some cases.

Accordingly, so as to solve the aforementioned problems, it is an object of the present invention to provide an insulated wire with an insulating layer, which exhibits high partial discharge inception voltage even with a thin thickness, and a coil using the same.

According to a feature of the invention, an insulated wire comprises:

a conductor; and an insulating layer formed on an outer periphery of the conductor, the insulating layer consisting essentially of a polyimide resin having a repeating unit A represented by Formula (1) as a part of a molecular structure, wherein a water absorption coefficient is not greater than 2.8% after 24 hours under condition at temperature of 4° C. and humidity of 95%.

(1)

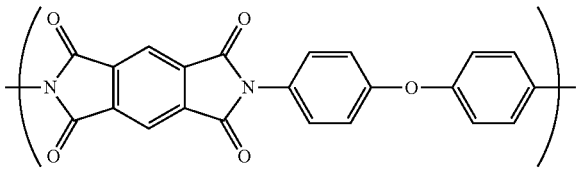

Further, the polyimide resin may further comprise a repeating unit B represented by Formula (2).

(2)

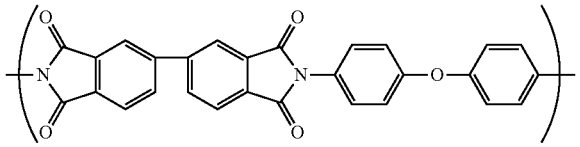

Still further, in the insulated wire, a molar ratio A:B of the polyamic acid A and the polyamic acid B in the polyimide resin is preferably 30:70 to 90:10.

According to another feature, a coil comprises the insulated wire according to the above feature.

(Points of the Invention)

According to the present invention, it is possible to provide an insulated wire with an insulating layer, which exhibits a high partial discharge inception voltage even with a thin thickness, and a coil using the same.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
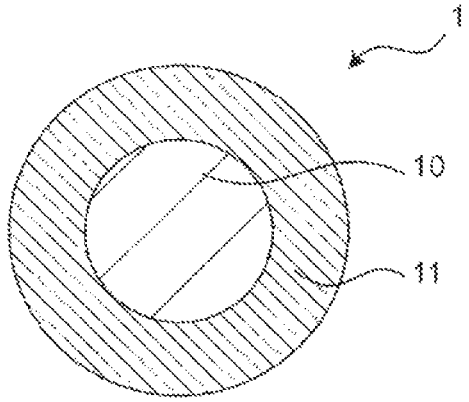
FIG. 1 is a cross-sectional view showing an insulated wire in one embodiment according to the present invention.

As described above, in the conventional polyimide resin used for the insulating layer of the insulated wire, there is a disadvantage in that the partial discharge inception voltage (PDIV) of the thin insulating layer is low since the convention polyimide resin has relatively high relative permittivity. To solve this problem, the Inventors have focused on a water absorption coefficient of the polyimide resin, and studied this subject intensively. The water absorption coefficient of polyimide resin tends to be influenced by the polarity of the polyimide resin, and increases in accordance with the increase in polarity. Further, the polarity shows uneven distribution of electron density among molecules in the polyimide resin. The magnitude of uneven electrical distribution increases as the polarity increases, thereby the relative permittivity increases. In other words, the magnitude of the water absorption coefficient corresponds to the magnitude of the relative permittivity, which serves as an indicative of PDIV.

The Inventors have conducted extensive studies for the water absorption coefficient of the polyimide resin, and found that an insulating layer with low relative permittivity and high PDIV would be achieved if the water absorption coefficient of the polyimide resin is within a predetermined numerical range, so that the present invention has been conceived.

EMBODIMENTS

Next, preferred embodiments according to the invention will be explained below in conjunction with the accompanying drawings.

Firstly, a polyimide varnish used to form a polyimide resin which constitutes an insulating layer will be explained.

(Polyimide Varnish)

The polyimide varnish contains polyamic acid. The polyamic acid is synthesized from carboxylic acid and diamine, and contains an amide bond in the molecule. The polyamic acid is polymerized by heating to form the polyimide resin having a predetermined repeating unit.

In the present embodiment, a polyimide resin comprising a repeating unit A as a part of the molecular structure is formed from a polyimide varnish containing polyamic acid comprising the repeating unit A formed by heating. The polyimide resin exhibits low relative permittivity and high partial discharge inception voltage, since the water absorption coefficient is not greater than 2.8% after 24 hours under the condition at temperature of 4° C. and humidity of 95%.

Next, components constituting the polyimide varnish will be explained below. Here, the polyamic acid to be heated to form the repeating unit A is defined as polyamic acid A.

(Polyamic acid A)

Polyamic acid A is synthesized from pyromellitic dianhydride (PMDA) as carboxylic acid and 4,4'-diaminodiphenyl ether (ODA) as diamine. The polyamic acid A has a structure represented by the following general formula (3).

(3)

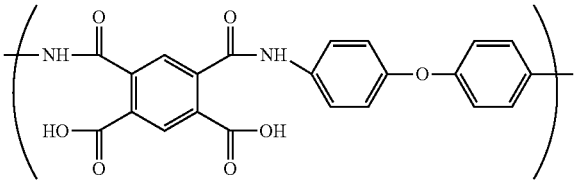

The polyamic acid A is dehydrated by heating for imidization to provide the repeating unit A in the polyimide resin. The repeating unit A has a structure represented by the following general formula (1).

(1)

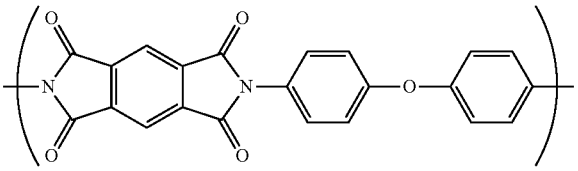

As shown in the general formula (1), the repeating unit A forms a conjugated structure via imide bond(s). Since the imide bond has a strong intermolecular force, the binding property in the repeating unit A is strong, so that the repeating unit A has a rigid molecular structure. Thus, the repeating unit A can impart predetermined electrical characteristics, mechanical characteristics, and heat resistance to the polyimide resin.

(Other Polyamic Acids)

Preferably, when the polyimide varnish is imidized to be polyimide resin, the polyimide varnish further contains another polyamic acid or other polyamic acids different from the polyamic acid A, such that the water absorption coefficient is not greater than 2.8% after 24 hours under the condition at temperature of 40° C. and humidity of 95%. The other polyamic acid is polyamic acid which forms a repeating unit different from the repeating unit A. As the other polyamic acid is not limited as long as it has a smaller polarity and lower water absorption coefficient as compared with those of the repeating unit A. For example, the polyamic acid synthesized from carboxylic anhydride and diamine, which are selected from following materials appropriately.

For the carboxylic anhydride, e.g. aromatic tetracarboxylic dianhydrides such as 4,4'-oxydiphthalic dianhydride (ODPA), 3,3',4,4'-biphenyltetracarboxylic dianhydride (s-BPDA) may be used. One or more of these aromatic tetracarboxylic dianhydrides may be used.

For the diamines, e.g. aromatic diamines such as 2,2-bis[4-(4-aminophenoxy)phenyl]propane (BAPP), 9,9-bis(4-aminophenoxy)fluorene (FDA), 4,4'-bis(4-aminophenoxy)biphenyl (BAPB), 3,3'-bis(4-aminophenoxy)biphenyl (M-BAPB) may be used. One or more of these aromatic diamines may be used.

(Polyamic Acid B)

As the other polyamic acid synthesized from carboxylic acid and diamine, it is preferable to use e.g., polyamic acid B synthesized from 3,3',4,4'-biphenyltetracarboxylic dianhydride (s-BPDA) as carboxylic acid and 4,4'-diaminodiphenyl ether (ODA) as diamine. The polyamic acid B has a structure represented by the following general formula (4).

(4)

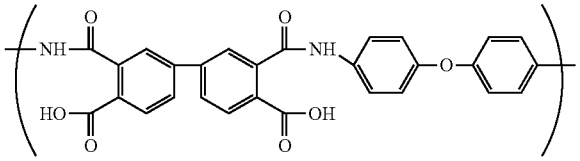

The polyamic acid B is dehydrated by heating for imidization to provide a repeating unit B in the polyimide resin. The repeating unit B has a structure represented by the following general formula(s). Since the polarity of the repeating unit B is smaller than the polarity of the repeating unit A, and the polyimide resin further comprising the repeating unit B exhibits the improved water absorption coefficient and relative permittivity as compared with the polyimide resin consisting of the repeating unit A, thereby exhibits the improved PDIV.

(2)

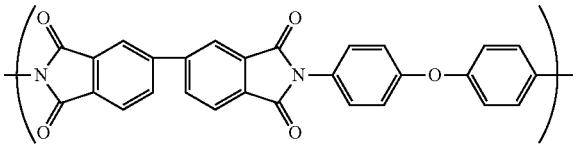

As shown by the above general formula (2), the repeating unit B has a biphenyl group derived from 3,3',4,4'-biphenyltetracarboxylic dianhydride (s-BPDA). The repeating unit B has a weak conjugation of electrons in the benzene ring derived from s-BPDA and a relatively small polarity. Therefore, the water absorption coefficient and relative permittivity are relatively low, so that high PDIV can be achieved. In contrast, the repeating unit A has electrons delocalized in PMDA and the polarization is generated in a carbonyl group (C═O) constituting an imide ring, so that the polarity is relatively large. Therefore, the water absorption coefficient and relative permittivity are relatively high, so that PDIV is relatively low. That is, by further providing the repeating unit B in the polyimide resin, the water absorption coefficient and relative permittivity of the polyimide resin can be improved, thereby the PDIV can be improved. In addition, the repeating unit B itself has a flexible molecular structure, which may reduce the heat resistance due to development of thermoplasticity in the polyimide resin. However, the reduction in heat resistance caused by the repeating unit B can be suppressed by being combined with the repeating unit A exhibiting the heat resistance.

A mixing ratio (molar ratio) of the polyamic acid A and the polyamic acid B corresponds to a mixing ratio (molar ratio) of the repeating unit A and the repeating unit B in the polyimide resin to be formed therefrom. In the present invention, the molar ratio is not particularly limited. However, if the molar ratio of the polyamic acid B (the repeating unit B) is less than 10 mol %, there is a possibility that the water absorption coefficient and relative permittivity of the polyimide resin may be increased, thereby PDIV may be deteriorated. In this case, thickening of the insulating layer is required to improve PDIV, so that thinning of the insulating layer and reduction in diameter of the insulated wire will become difficult. On the other hand, if the molar ratio of the polyamic acid B (repeating unit B) exceeds 70 mol %, the polyimide resin will have a flexible molecular structure, there is a possibility that the thermoplasticity may be developed, thereby glass transition temperature (Tg), storage elastic modulus or the like at high temperature may be lowered. In this case, swelling or deformation occurs in the insulating layer to be formed in the processing at a temperature region close to Tg, which may cause problems in heat resistance. Moreover, if the molar ratio of the polyamic acid B is too large, the polyimide varnish may be whitened and the appearance of the insulating layer to be formed may be deteriorated. Thus, the molar ratio of the polyamic acid A and the polyamic acid B, i.e. the molar ratio of the repeating unit A and the repeating unit B (A:B) is preferably 30:70 to 90:10, more preferably 40:60 to 90:10. By setting the molar ratio within the above-described numerical ranges, it is possible to impart excellent flexibility to the insulating layer as well as to reduce the relative permittivity of the insulating layer.

The polyimide varnish may further contain polyamic acid different from the polyamic acid B as the other polyamic acid. In other words, the polyimide resin in the present embodiment may further include other repeating unit which is different from the repeating unit B.

Such polyamic acid may be different from the polyamic acid B synthesized from s-BPDA and ODA, and may be synthesized from carboxylic anhydride excluding s-BPDA, and ODA as diamine More specifically, as carboxylic dianhydrides, e.g., 3,3',4,4'-benzophenone-tetracarboxylic dianhydride (BTDA), 3,3',4,4'-diphenyl sulfone-tetracarboxylic dianhydride (DSDA), 4,4'-oxydiphthalic dianhydride (ODPA), 3,3',4,4'-biphenyltetracarboxylic dianhydride and 4,4'-(2,2-hexafluoroisopropylidene) diphthalic dianhydride (6FDA), or the like may be used. In addition, butanetetracarboxylic dianhydride, 5-(2,5-dioxotetrahydro-3-furanyl)-3-methyl-3-cyclohexene-1,2-dicarboxylic anhydride or alicyclic tetracarboxylic dianhydrides obtained by hydrogenating the above-mentioned tetracarboxylic dianhydrides or the like may be concurrently used, if required.

In the case that the polyamic acid other than the polyamic acid B is contained, the additive amount (number of moles) of the other polyamic acid relative to the total number of moles of the polyamic acid A and polyamic acid B is preferably not greater than 25% In this numerical range, it is possible to provide an excellent insulating layer without compromising the characteristics of the insulating layer significantly.

(Method for Producing a Polyimide Varnish)

A polyimide varnish is produced by dissolving carboxylic anhydride and diamine in solvent and synthesizing polyamic acid therefrom. When producing a polyimide varnish containing the polyamic acid A and polyamic acid B, PMDA for forming the polyamic acid A and s-BPDA for forming the polyamic acid B as carboxylic anhydride, and ODA as diamine are dissolved in a solvent, and the polyamic acid A and the polyamic acid B are synthesized, respectively.

The additive amount of each of PMDA and s-BPDA as carboxylic anhydride is determined by the molar ratio of the repeating unit A and the repeating unit B in the polyimide resin.

Further, the additive amount of each of carboxylic anhydride and diamine is preferably determined such that the molar ratio of carboxylic anhydride and diamine falls within a range of 100:100.1 to 100:105, or alternatively, the molar ratio of carboxylic anhydride and diamine falls within in a range of 100.1:100 to 105:100. By adding diamine slight excessively relative to carboxylic anhydride, or adding carboxylic anhydride slight excessively relative to diamine, the molecular mass of the polyamic acid to be formed can be controlled to be small. It is possible to improve the coating workability for forming the insulating layer by reducing the viscosity of the polyimide varnish by controlling the molecular mass to be small.

As the solvent, N-methyl-2-pyrrolidone (NMP), γ-butyrolactone, N,N-dimethylacetamide (DMAC), N,N-dimethylformamide (DMF), dimethyl imidazolidinone (DMI), cyclohexanone, methyl cyclohexanone, hydrocarbon-based solvent or the like may be used. Further, these solvents may be used in combination appropriately as long as such combination does not impair the properties of the polyimide varnish.

For synthesis of the polyamic acid A and polyamic acid B, they can be synthesized at enough temperature not to impair the properties of the polyamic acid to be obtained, e.g. synthesized by heating at a temperature of 0° C. or more and 100° C. or less.

In addition, after synthesizing the polyamic acid A and polyamic acid B, the polyamic acid A and polyamic acid B may be heated and stirred at about 50° C. to 100° C. again so as to adjust the viscosity of polyimide varnish.

(Insulated Wire)

Next, with reference to the FIG. 1, an insulated wire comprising an insulating layer formed from the polyimide varnish as described above on the outer periphery of a conductor. FIG. 1 is a diagram showing a cross-sectional view of an insulated wire in one embodiment according to the present invention.

An insulated wire 1 in the present embodiment comprises a conductor 10 and an insulating layer 11 formed on the outer periphery of the conductor 10. The insulating layer 11 is consisted essentially of polyimide resin having the repeating unit A represented by the following general formula (1) as a part of the molecular structure, in which the water absorption coefficient is not greater than 2.8% after 24 hours under the condition at temperature of 40° C. and humidity of 95%. Preferably the polyimide resin further comprises the repeating unit B represented by the following general formula (2).

(1)

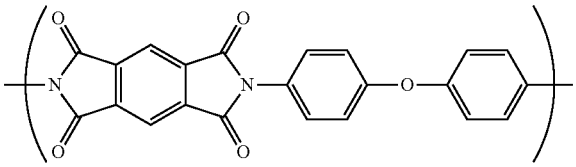

(2)

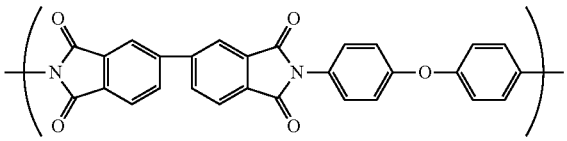

(Conductor)

As the conductor 10, copper wires made of oxygen-free copper or low oxygen copper, other copper alloy wires, wires of other metals such as silver may be used. The cross sectional shape of the conductor 10 is not particularly limited, and may be e.g. a circular shape, as shown in FIG. 1. The conductor diameter of the conductor 10 is not particularly limited, and the optimum diameter may be appropriately selected depending on the application.

(Insulating Layer)

The insulating layer 11 covers the conductor 10 and imparts predetermined electrical characteristics, mechanical characteristics, and heat resistance to the insulated wire 1.

The insulating layer can be formed by, e.g., applying the polyimide varnish on the outer periphery of the conductor 10 and baking it in a furnace at, e.g., 350 to 500° C. for 1 to 2 minutes. This is repeated ten to twenty times to increase a film thickness, thereby forming the insulation layer. During baking, polyamic acid contained in the polyimide varnish is imidized to form the polyimide resin. In the present embodiment, the insulating layer 11 is formed from the polyimide varnish containing the polyamic acid A, and composed of the polyimide resin comprising the repeating unit A derived from the polyamic acid A as a part of the molecular structure. Further, the water absorption coefficient of the insulating layer 11 is not greater than 2.8% after 24 hours under the condition at temperature of 40° C. and humidity of 95%. Thus, the insulating layer 11 has small relative permittivity, thereby exhibits high PDIV.

More preferably, the insulating layer 11 is formed from the polyimide varnish containing the polyamic acid A and polyamic acid B, and composed essentially of the polyimide resin comprising the a repeating unit A derived from the polyamic acid A, and the repeating unit B derived from the polyamic acid B.

In the polyimide resin constituting the insulating layer 11, the repeating unit A exhibits predetermined mechanical characteristics and heat resistance, but has relatively high polarity, so that the repeating unit A may increase the water absorption coefficient and relative permittivity, thereby reduce PDIV. On the other hand, the repeating unit B reduces the heat resistance by expressing the thermoplasticity, but improves the relative water absorption coefficient and relative permittivity because of relatively small polarity, thereby improving PDIV. By providing the polyimide resin with the repeating unit A and the repeating unit B, it is possible to reduce the proportion of the repeating unit A, thereby suppress the relative permittivity to be low. Furthermore, because of the repeating unit A exhibiting the heat resistance, it is possible to suppress the lowering of the heat resistance due to the repeating unit B, thereby maintain the heat resistance. That is, in the polyimide resin having both the repeating unit A and repeating unit B, it is possible to complement the characteristics of the repeating unit A and repeating unit B each other.

In the polyimide resin constituting the insulating layer 11, the molar ratio of the repeating unit A and the repeating unit B (A:B) is not particularly limited, but preferably the molar ratio (A:B) is 30:70 to 90:10, more preferably 40:60 to 90:10. According to the polyimide resin with a predetermined molar ratio, since the water absorption coefficient is not greater than 2.8%, preferably not greater than 2.3%, it is possible to suppress the relative permittivity to be even lower, thereby further improving PDIV. Further, in addition to the characteristics of each of the repeating unit A and repeating unit B, it is possible to obtain excellent flexibility. In the polyimide resin, the arrangement of the repeating unit A and repeating unit 8 is not particularly limited, for example, the repeating unit A and repeating unit B may be arranged alternately or randomly.

The polyimide resin constituting the insulating layer may comprise a repeating unit other than the repeating unit A and repeating unit B. The other repeating unit preferably comprises 25% of the total number of moles of the repeating unit A and repeating unit B.

Moreover, since the insulating layer is constituted from the polyimide resin having a small relative permittivity, a predetermined partial discharge inception voltage can be achieved even though the thickness of the insulating layer is thin. Specifically, even though the thickness of the insulating layer is thin, e.g., thickness of 40 μm, it is possible to achieve partial discharge inception voltage of 900 Vp or more. That is, according to the insulated wire in the present embodiment, it is possible to reduce the diameter of the insulated wire by reducing the thickness of the insulating layer.

(Coil)

The coil in the present embodiment according to the present invention is formed with the use of the insulated wire as described above. Since it is possible to reduce the diameter of the insulated wire, it is possible to provide a coil with a higher space factor by wiring the insulated wire more dense. Further, since the partial discharge inception voltage is high, the insulated wire may provide a higher output by applying a high voltage to the coil. Accordingly, the coil in the present embodiment can be used for small-sized motors driven at a high voltage.

Effects of the Embodiment

According to the present embodiment, one or mote of the following effects can be achieved.

According to the present embodiment, the insulating layer of the insulated wire is composed essentially of the polyimide resin comprising the repeating unit A represented by the general formula (1) as a part of the molecular structure, in which the water absorption coefficient is not greater than 2.8% after 24 hours under the condition at temperature of 4° C. and humidity of 95%. The insulating layer is composed essentially of the predetermined polyimide resin and has low water absorption coefficient, so that the relative permittivity is low and the insulating layer exhibits higher partial discharge inception voltage.

Further, according to the present embodiment, since the insulating layer is composed essentially of the polyimide resin having low water absorption coefficient and relative permittivity the insulating layer exhibits excellent partial discharge inception voltage even though the thickness is thin. That is, in the present embodiment, a narrow diameter insulated wire can be achieved by reducing the thickness of the insulating layer.

Further, according to the present embodiment, the insulating layer has low water absorption coefficient, so that the deterioration in partial discharge inception voltage due to moisture can be suppressed. Thus, the environment for using the insulated wire in the present embodiment is not limited.

Still further, according to the present embodiment, the molar ratio of the repeating unit A and repeating unit B (A:B) is 30:70 to 90:10, more preferably 40:60 to 90:10, so that the water absorption coefficient and the relative permittivity of the insulating layer can be further lowered, thereby improving the partial discharge inception voltage. Furthermore, it is possible to impart excellent flexibility to the insulating layer.

Further, according to the present embodiment, by using the insulated wire for the electrical equipment such as a coil, it is possible to achieve higher output along as well as miniaturization of the electric equipment.

Other Embodiments

Figure 2:
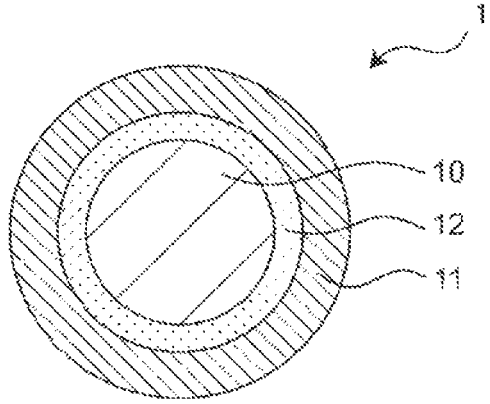
FIG. 2 is a cross-sectional view showing an insulated wire in another embodiment according to the present invention.

In the above embodiment, the insulated wire 1 comprising an insulating layer 11 on the outer periphery of the conductor 10 is explained. However, the present invention is not limited thereto. For example, when the insulating layer 11 consisted essentially of the specified polyimide resin is the first insulating layer 11, a second insulating layer 12 may be interposed between the insulating layer 11 and the first conductor 10 as shown in FIG. 2. In other words, it is also possible to configure the insulated wire 1 comprising the conductor 10, the second insulating layer 12, and the first insulating layer 11. By interposing the second insulating layer 12, e.g. the second insulating layer 12 with high adhesiveness, between the first conductor 10 and the first insulating layer 11, it is possible to improve the adhesion with the conductor 10, which is insufficiently achieved when providing only the first insulating layer 11.

The resin constituting the second insulating layer 12 is not particularly limited, as long as the resin is a resin containing an imide structure component in the molecule. Examples of such resins include, e.g. polyamide-imide, polyimide, polyester imide, and the like. Further, as the polyamide-imide, polyamide-imide comprising tricarboxylic anhydrides such as trimellitic anhydride (TMA) and isocyanate such as 4,4'-diphenylmethane diisocyanate (MDI) compounded in equal molar amounts, or the like may be used. As the polyimide, polyimide comprising tetracarboxylic acid dianhydride such as pyromellitic dianhydride (PMDA) and diamine compound such as 4,4'-diaminodiphenyl ether (ODA) compounded in equal molar amounts, or the like may be used. Further, as the polyester-imide, polyester-imide modified with tris-2(hydroxyethyl isocyanurate), or the like may be used.

The second insulating layer 12 is formed by heating and baking the insulation varnish comprising the aforementioned resin dissolved in an organic solvent. Commercialized insulating varnishes may be used for the formation of the second insulating layer 12. For example, polyimide resin insulating varnish such as TORAYNEECE #3000 (Trademark) (manufactured by Toray Industries, Inc.), Pyre-ML (Trademark) (manufactured by DuPont Co., Ltd.), polyamide-imide resin insulating varnish such as HI406 (Trade name) (manufactured by Hitachi Chemical Co., Ltd.), polyester-imide resin insulating varnish such as Isomid40SM-45 (Trade name) (manufactured by Hitachi Chemical Co., Ltd.), or the like may be used.

Preferably, the second insulating layer 12 includes additives such as melamine-based compound such as alkylated hexamethylol melamine resin, sulfur-containing compound typified by mercapto-based compound, in order to improve the adhesion to the conductor 10. Other compounds may be also used as long as it expresses high adhesiveness.

Figure 3:
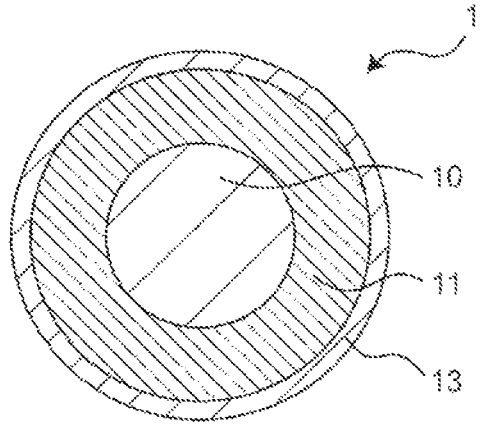
FIG. 3 is a cross-sectional view showing an insulated wire in still another embodiment according to the present invention.

In the above embodiment, the insulated wire 1 comprising the insulating layer 11 on the outer periphery of the conductor 10 has been explained, but the present invention is not limited thereto. For example, as shown in FIG. 3, a lubricating layer 13 containing a lubricant may be further provided or the outer periphery of the insulating layer 11. According to the lubricating layer 13, it is possible to impart lubricity to the surface of the insulated wire 1, thereby relax the machining stress during the process of forming a coil by winding the insulated wire 1. The lubricating layer 13 is formed from a lubricious varnish containing a lubricant and enamel varnish, such as polyimide, polyester-imide, and polyamide imide. The lubricant may be one kind or a mixture of two or more kinds selected from the group consisting of polyolefin wax, fatty amide, and fatty acid ester. In particular, one kind of fatty acid amide or polyolefin wax, or a mixture thereof is preferable, but the present invention is not limited thereto. As the lubricating layer, it is also possible to use a lubricious enamel varnish comprising an enamel varnish with a chemical structure into which an aliphatic component having lubricating property is introduced. The lubricating layer is formed by baking the above varnish.

In the above embodiment, polymer terminals may be capped in the polyimide resin constituting the insulation layer 11 in the present embodiment. As a material used for capping, it is possible to use a compound containing acid anhydride or a compound containing amino group. The capping compound containing acid anhydride includes, e.g., phthalic anhydride, 4-methylphthalic anhydride, 3-methylphthalic anhydride, 1,2-naphthalic anhydride, maleic anhydride, 2,3-naphthalenedicarboxylic anhydride, various fluorinated phthalic anhydrides, various brominated phthalic anhydrides, various chlorinated phthalic anhydrides, 2,3-anthracenedicarboxy anhydride, 4-ethynylphthalic anhydride and 4-phenylethylphthalic anhydride, etc. As the capping compound containing amino group, a compound containing one amino group can be selected and used.

EXAMPLES

Next, Examples of the present invention will be explained below. In Examples, samples of the insulated wire according to the present invention were prepared by following method under following conditions. These Examples are only examples of the insulated wire according to the present invention, and the present invention is not limited to these Examples.

Example 1

For manufacturing an insulated wire, a polyimide varnish used for forming an insulating layer consisting essentially of polyimide resin was prepared by the method as described below.

(Preparation of Polyimide Varnish)

Firstly, 437.5 g of 4,4'-diaminodiphenyl ether (ODA) as diamine was dissolved in 3697.2 g of N-methyl-2-pyrrolidone (NMP) as solvent. Thereafter, 393.2 g of pyromellitic acid anhydride (PMDA) and 93.6 g of 3,3',4,4'-biphenyltetracarboxylic dianhydride (s-BPDA) as carboxylic anhydrides were dissolved in NMP as the solvent. Then, by being synthesized with stirring for 12 hours at room temperature in a nitrogen environment, a polyimide varnish containing the polyamic acid A and polyamic acid B was prepared. In order to improve the coating workability of the polyimide varnish, the polyimide varnish was diluted by adding the solvent to the varnish. In Example 1, the polyimide varnish comprising the polyimide resin in which the molar ratio of the repeating unit A and the repeating unit B is 85:15 was prepared by adjusting the molar ratio of PMDA, s-BPDA, and ODA to be 85:15:103. Table 1 shows the preparation conditions of polyimide varnishes.

TABLE 1

| | | | Ex 1 | Ex 2 | Ex 3 | Ex 4 | Ex 5 | Comparative Ex 1 |
|---|---|---|---|---|---|---|---|---|
| Composition of Insulating varnish | Carboxylic anhydride | PMDA (Pyromellitic acid anhydride | 393.2 | 277.6 | 185.1 | 138.8 | 416.4 | 462.6 |
| | | s-BPDA (3,3',4,4'-biphenyl tetracarboxylic dianhydride) | 93.6 | 249.6 | 374.4 | 436.8 | 62.4 | — |
| | | Molar ratio (PMDA):(s-BPDA) | 85:15 | 60:40 | 40:60 | 30:70 | 90:10 | — |
| | Diamine | ODA (4,4'-diaminodiphenyl ether) | 437.5 | 437.5 | 437.5 | 437.5 | 437.5 | 437.5 |

(Manufacturing of Insulated Wire)

Next, an insulated wire was manufactured with the use of the polyimide varnish that has been prepared. An insulated wire in Example 1 comprising an insulating layer of 40 μm thick, was obtained by repeating 15 times the process of coating the outer periphery of a copper wire (with a diameter of 0.8 mm) with the polyimide varnish in Example 1, and baking the coated copper wire for 90 seconds in the varnish baking oven at 450° C.

(Evaluation of Insulated Wire)

Next, as to the insulated wire in Example 1, partial discharge inception voltage (PDIV), water absorption coefficient, and flexibility were evaluated. The evaluation method for each factor will be described below.

(1) Partial Discharge Inception Voltage

The partial discharge inception voltage (PDIV) was measured at detection sensitivity of 10 pC, and a frequency of 50 Hz in a constant temperature and humidity chamber at a temperature of 25° C.

As a result of the measurement of the PDIV of the insulated wire in Example 1, it was confirmed that the PDIV was 920 Vp and that the insulated wire has high PDIV which is 900 Vp or more.

(2) Water Absorption Coefficient

The water absorption coefficient rate was calculated from the weight increased by the water absorption of the insulating layer after the insulated wire has been stored for 24 hours in an environment of a temperature of 40° C. and humidity of 95%.

As a result of the measurement of the water absorption coefficient of the insulated wire in Example 1, the water absorption coefficient was not greater than 2.3%, and it was confirmed that the water absorption coefficient is low.

(3) Flexibility

The flexibility was evaluated by following method. The manufactured insulated wire was elongated (extended) by the method conforming to JISC3003, and the elongated insulated wire was wound around a rod having the same diameter as the conductor diameter of the insulated wire by the method conforming to JISC3003. Thereafter, the presence of defect such as cleavage, cracks, in the insulating layer was observed with the use of an optical microscope. As to the evaluation classification, when no defect was confirmed in the insulating layer in the insulated wire with the elongation of 40%, the flexibility was evaluated as "◎" (Excellent). When no defect was observed in the insulating layer with the elongation of 20%, the flexibility was evaluated as "o" (Good). When the defect(s) was observed in the insulating layer with the elongation of 20%, the flexibility was evaluated as "x" (not good).

As a result of the evaluation of the flexibility of the insulated wire in Example 1, it was confirmed that defects such as cleavage, cracking were not observed in the insulating layer even in the case that the insulated wire was elongated with the elongation of 40%, so that it is concluded that the insulated wire in Example 1 has excellent flexibility.

Table 2 shows the results of the evaluation.

TABLE 2

| | Example 1 | Example 2 | Example 3 | Example 4 | Example 5 | Comparative Example 1 |
|---|---|---|---|---|---|---|
| Partial Discharge Inception Voltage (PDIV) \|Vp\| | 920 | 955 | 965 | 970 | 905 | 875 |
| Water absorption coefficient [%] | 2.3 | 1.7 | 1.2 | 1.1 | 2.8 | 3.5 |
| Flexibility | ◎ | ◎ | ◎ | ○ | ◎ | ◎ |

Examples 2 to 5

In Examples 2 to 5, as shown in Table 1, polyimide varnishes were prepared by appropriately changing the additive amount of PMDA and s-BPDA as carboxylic anhydrides, to manufacture insulated wires in the same manner as the insulated wire in Example 1.

Example 2

In Example 2, polyimide varnish was prepared with using 277.6 g of PMDA and 249.6 g of s-BPDA as carboxylic anhydrides. Namely in Example 2, the polyimide varnish was prepared with the molar ratio of PMDA, s-BPDA, and ODA being 60:40:103, such that the molar ratio of the repeating unit A and the repeating unit B in the polyimide resin was 60:40.

Example 3

In Example 3, polyimide varnish was prepared with using 185.1 g of PMDA and 374.4 g of s-BPDA as carboxylic anhydrides. Namely, in Example 3, the polyimide varnish was prepared with the molar ratio of PMDA, s-BPDA, and ODA being 40:60:103, such that the molar ratio of the repeating unit A and the repeating unit B in the polyimide resin was 40:60.

Example 4

In Example 4, polyimide varnish was prepared with using 138.8 g of PMDA and 436.8 g of s-BPDA as carboxylic anhydrides. Namely, in Example 4, the polyimide varnish was prepared with the molar ratio of PMDA, s-BPDA, and ODA being 30:70:103, such that the molar ratio of the repeating unit A and the repeating unit B in the polyimide resin was 30:70.

Example 5

In Example 5, polyimide varnish was prepared with using 416.4 g of PMDA and 62.4 g of s-BPDA as carboxylic anhydrides. Namely, in Example 5, the polyimide varnish was prepared with the molar ratio of PMDA, s-BPDA, and ODA being 90:10:103, such that the molar ratio of the repeating unit A and the repeating unit B in the polyimide resin was 90:10.

The insulated wires in Examples 2 to 5 manufactured by using the polyimide varnishes in Examples 2 to 5 were evaluated in the same manner as the insulated wire in Example 1. As shown in Table 2, it was confirmed that all the insulated wires in Examples 2 to 5 have high PDIV and low water absorption coefficient. In particular, as to the insulated wires in Examples 2 to 4, the molar ratio of the repeating unit A and the repeating unit B (A:B) is 60:40 to 30:70. It was confirmed that the insulated wires in Examples 2 to 4 have excellent PDIV and low water absorption coefficient. Further, in any insulated wire in Examples 2 to 5, it was confirmed, that a predetermined flexibility was achieved.

Comparative Example 1

In Comparative Example 1, as shown in Table 1, a polyimide varnish was prepared by using only PMDA without using s-BPDA as carboxylic anhydride. More specifically, 437.5 g of ODA as diamine was dissolved in 3600.4 g of NMP as solvent. Thereafter, 462.6 g of PMDA as carboxylic anhydrides was dissolved therein. Then, by being synthesized with stirring for 12 hours at room temperature in a nitrogen environment, a polyimide varnish was prepared.

In Comparative Example 1, the polyimide varnish comprising the polyimide resin containing only the repeating unit A was prepared by adjusting the molar ratio of PMDA and ODA to be 100:103.

The insulated wire in Comparative Example 1 manufactured by using the polyimide varnish in Comparative Example 1 was evaluated in the same manner as the insulated wire in Example 1. As shown, in Table 2, it was confirmed that that PDIV is 875 Vp which is lower than 900 Vp. Further, it was confirmed that the water absorption coefficient is 3.5%, which is relatively higher water absorption coefficient.

As described above, according to the present invention, it is possible to provide an insulated wire with an insulating layer which exhibits a high partial discharge inception voltage with a thin thickness, and a coil using the same. Since the partial discharge inception voltage is high, even in the case of thinning the thickness of the insulating layer, it is possible to achieve a predetermined partial discharge inception voltage, so that it is possible to provide a narrow diameter insulated wire. Further, since the water absorption coefficient is low, the reduction in the partial discharge inception voltage due to the water absorption can be suppressed, so that the environment of using the insulated wire is not limited.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An insulated wire, comprising:

a conductor; and an insulating layer formed on an outer periphery of the conductor, wherein a molecular structure of the insulating layer consists of a polyimide resin consisting of a repeating unit A, synthesized from pyromellitic dianhydride (PMDA) and 4,4'-diaminodiphenyl ether (ODA), represented by Formula (1) and a repeating unit B, synthesized from 3,3',4,4'-biphenyltetracarboxylic dianhydride (s-BPDA) and ODA, represented by Formula (2), wherein a molar ratio A:B of the repeating unit A and the repeating unit B in the polyimide resin is 85:15 to 90:10, wherein a water absorption coefficient of the polyimide resin is not greater than 2.8% after 24 hours under condition at temperature of 40° C. and humidity of 95%

(1)

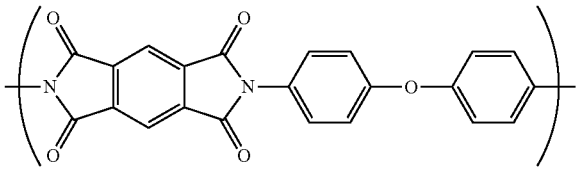

(2)

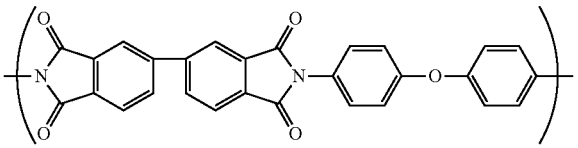

wherein the insulating layer is formed by applying a varnish on the outer periphery of the conductor, the varnish consisting of a solvent, ODA, PMDA, and s-BPDA, and baking the varnish, thereby providing the repeating unit A represented by Formula (1) and the repeating unit B represented by Formula (2) by dehydration by heating, wherein the molar ratio of PMDA to s-BPDA is within the range of 85:15 to 90:10; and wherein the varnish has a molar ratio of carboxylic anhydride to diamine within the range of 100:100.1 to 100:105.

2. The insulated wire according to claim 1, wherein the solvent is selected from N-methyl-2-pyrrolidone (NMP), γ-butyrolactone, N,N-dimethylacetamide (DMAC), N,N-dimethylformamide (DMF), dimethyl imidazolidinone (DMI), cyclohexanone, and methyl cyclohexanone.

3. The insulated wire according to claim 1, wherein a polarity of the repeating unit B is smaller than a polarity of the repeating unit A.

* * * * *